US009517646B2

(12) United States Patent
Sano

(10) Patent No.: US 9,517,646 B2
(45) Date of Patent: Dec. 13, 2016

(54) IMAGE RECORDING APPARATUS

(71) Applicant: BROTHER KOGYO KABUSHIKI KAISHA, Nagoya-shi, Aichi-ken (JP)

(72) Inventor: Iwane Sano, Obu (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 10 days.

(21) Appl. No.: 14/865,290

(22) Filed: Sep. 25, 2015

(65) Prior Publication Data

US 2016/0089901 A1 Mar. 31, 2016

(30) Foreign Application Priority Data

Sep. 25, 2014 (JP) ..... 2014-194544

(51) Int. Cl.
*B41J 2/01* (2006.01)
*B41J 13/10* (2006.01)
*B41J 3/60* (2006.01)

(52) U.S. Cl.
CPC .. *B41J 13/10* (2013.01); *B41J 3/60* (2013.01)

(58) Field of Classification Search
None
See application file for complete search history.

(56) References Cited

U.S. PATENT DOCUMENTS 6,357,848 B1 * 3/2002 Underwood ..... B41J 13/0027 271/265.01
8,240,655 B2 * 8/2012 Samoto ..... B41J 3/60 271/10.13
2013/0277170 A1 * 10/2013 Samoto ..... B65G 39/18 198/367

FOREIGN PATENT DOCUMENTS

JP 5-556 A 1/1993
JP 2012-71565 A 4/2012

OTHER PUBLICATIONS

English translation of JP 2012-071565A to Asada, Tetsuo, Image Forming Apparatus, Apr. 12, 2012, Japan, pp. 1-12.*

* cited by examiner

*Primary Examiner* — Matthew Luu
*Assistant Examiner* — Tracey McMillion
(74) *Attorney, Agent, or Firm* — Merchant & Gould P.C.

(57) ABSTRACT

An image recording apparatus, including a tray, a chassis defining a first conveyer path and a second conveyer path, a base member including a guiding section that forms a part of the second conveyer path, a recording unit, and a conveyer roller to convey the sheet in the first conveyer path in a first conveying direction, is provided. The second conveyer path guides an inverted sheet from an upstream of the recording unit with regard to the first conveying direction to the first conveyer path through a curved path. The guiding section includes a first guiding plane, which forms a part of the second conveyer path on an upstream of the curved path with regard to the second conveying direction, and a second guiding plane, which adjoins the first guiding plane along a widthwise direction and is formed to dent with respect to the first guiding plane.

10 Claims, 10 Drawing Sheets

IMAGE RECORDING APPARATUS

CROSS REFERENCE TO RELATED APPLICATION

This application claims priority from Japanese Patent Application No. 2014-194544, filed on Sep. 25, 2014, the entire subject matter of which is incorporated herein by reference.

BACKGROUND

Technical Field

The present invention relates to an image recording apparatus capable of recording an image on either side of a sheet.

Related Art

An image recording apparatus capable of recording an image on either side of a sheet is known. The image recording apparatus may have a first conveyer path, along which a recording unit is disposed, and a second conveyer path, which inverts the sheet with the image recorded on a first side and directs the inverted sheet to the first conveyer path so that another image may be recorded on a second side of the sheet. The image recording apparatus may have a configuration to direct the sheet from the second conveyer path through a curved path to a conveyer roller, which is disposed in the first conveyer path.

Meanwhile, in order to reduce a size, a quantity of parts, and manufacturing cost of the image recording apparatus, a paper chute serving as a part of a conveyer path to guide the sheet may be integrally formed in a base member, which is made of a resin.

SUMMARY

In order to downsize the image recording apparatus, the curved path may be formed to have a smaller curvature radius. In this regard, however, an impact of backlash from a tail end of the sheet traveling through the curved path may be increased. The impact of backlash may be lowered if the base member is formed to be thinner; however, the thinner base member may not provide substantial rigidity.

The present disclosure is advantageous in that an image recording apparatus, in which rigidity of the base member may be maintained and the impact of backlash may be lowered, is provided.

According to an aspect of the present disclosure, an image recording apparatus, including a tray configured to support a sheet; a chassis defining a first conveyer path, in which the sheet supported on the tray is conveyed in a first conveying direction, and a second conveyer path, in which the sheet is conveyed in a second conveying direction to be inverted and guided to reenter the first conveyer path; a base member integrally formed of resin and including a guiding section, the guiding section defining a form of a part of the second conveyer path; a recording unit configured to record an image on the sheet conveyed in the first conveyer path; and a conveyer roller disposed on an upstream of the recording unit with regard to the first conveying direction and configured to convey the sheet in the first conveyer path in the first conveying direction, is provides. The second conveyer path is configured to guide the sheet from a position on the upstream of the recording unit with regard to the first conveying direction to the first conveyer path through a curved path. The guiding section includes a first guiding plane defining a form of a part of the second conveyer path on an upstream of the curved path with regard to the second conveying direction on a same side as a first guide member which defines a form of an outer side of the curved path; and a second guiding plane arranged to adjoin the first guiding plane along a widthwise direction which intersects with the second conveying direction, the second guiding plane being formed to dent with respect to the first guiding plane to be farther from a second guide member which faces with the guiding section across the second conveyer path.

BRIEF DESCRIPTION OF THE ACCOMPANYING DRAWINGS

Figure 5:
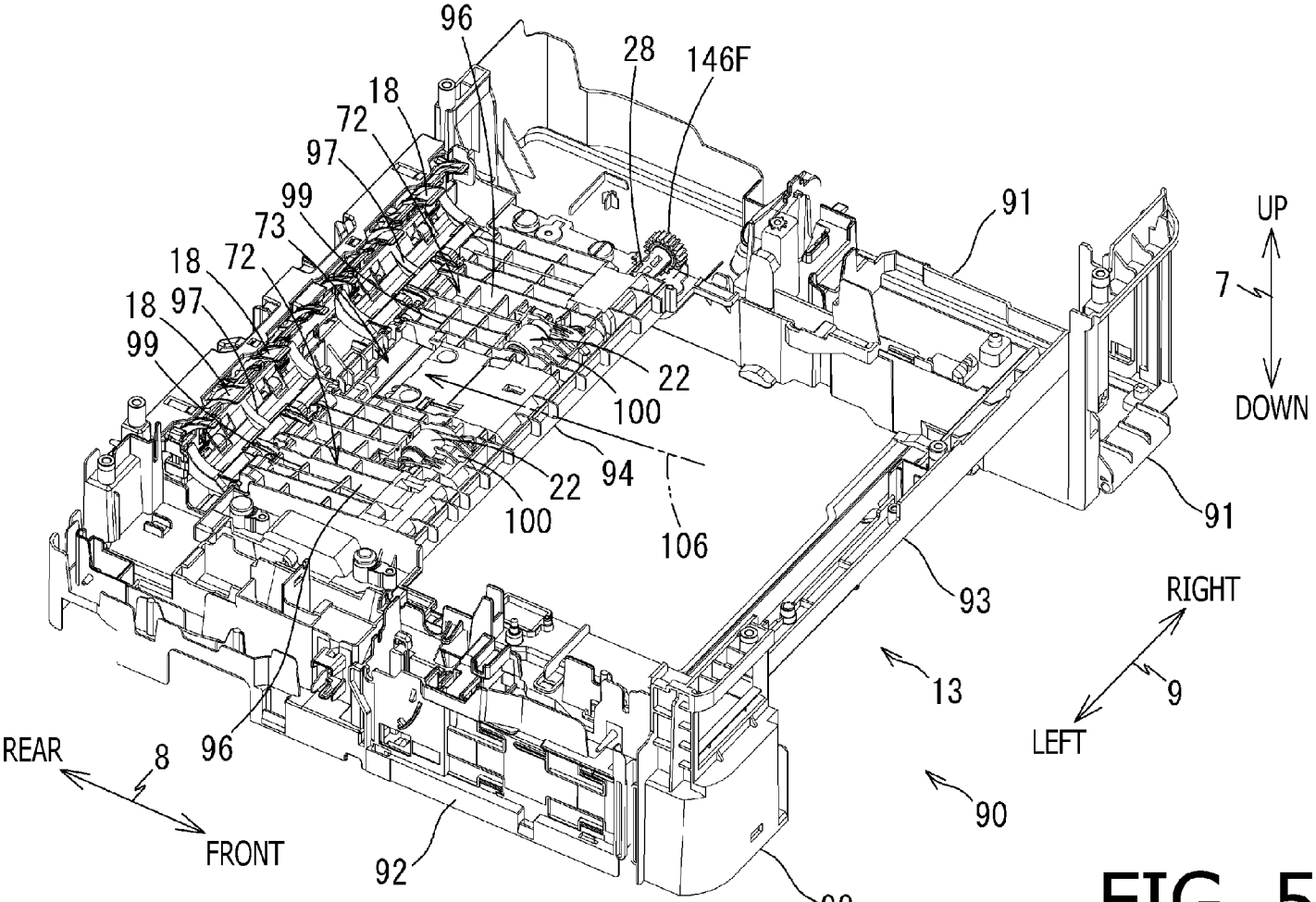

FIG. 5 is a perspective view of the base member 90, accompanied with a return-conveyer roller 22, a second flapper 97, and an outer guide member 18, in the MFD 10 according to the embodiment of the present disclosure.

Figure 6:
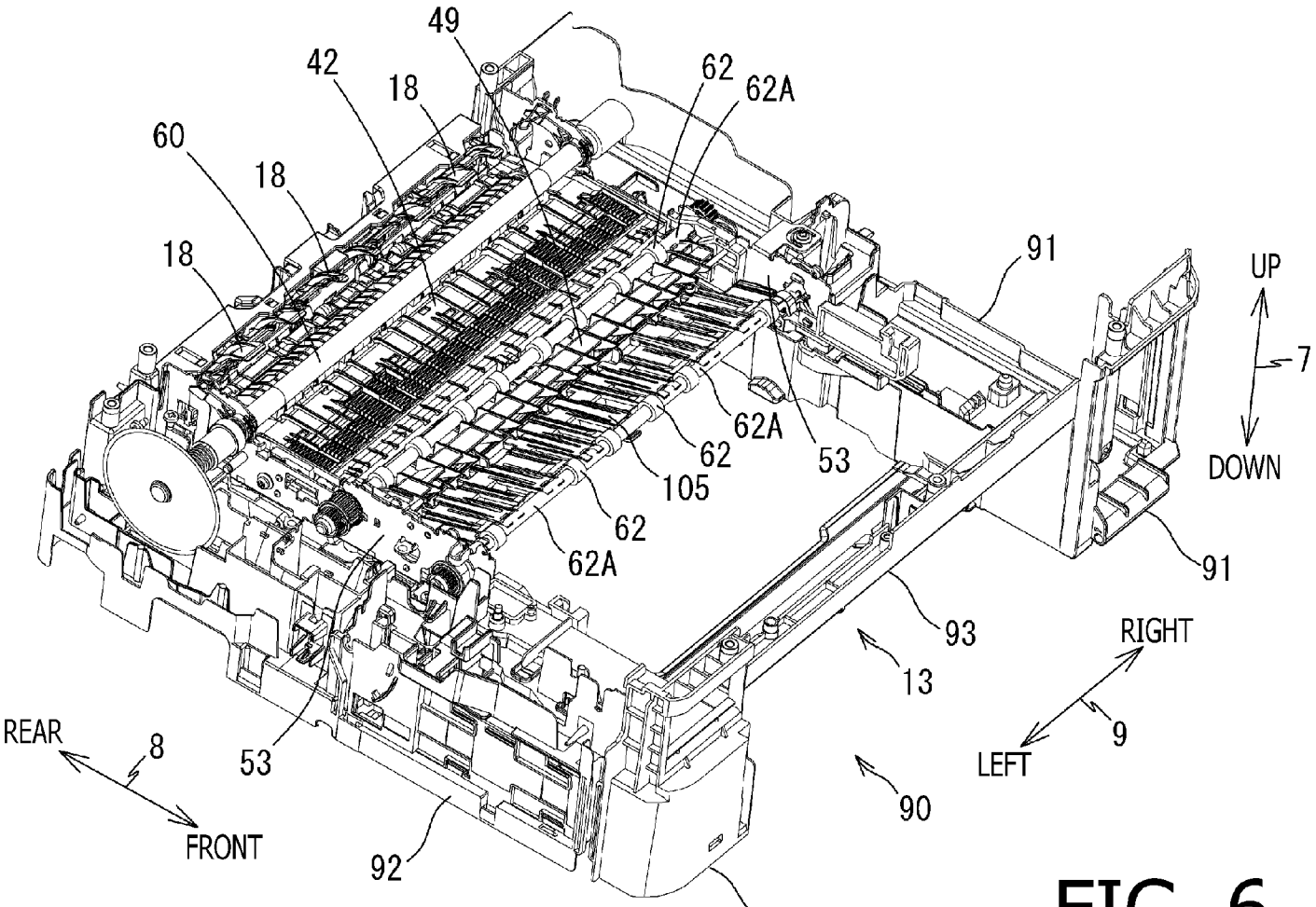

FIG. 6 is a perspective view of the base member 90, accompanied with a platen 42, a lower guide member 105, a first flapper 49, a conveyer roller 60, a discharge roller 62, a reversible roller 67, and a lateral frame 53, in the MFD 10 according to the embodiment of the present disclosure.

Figure 7:
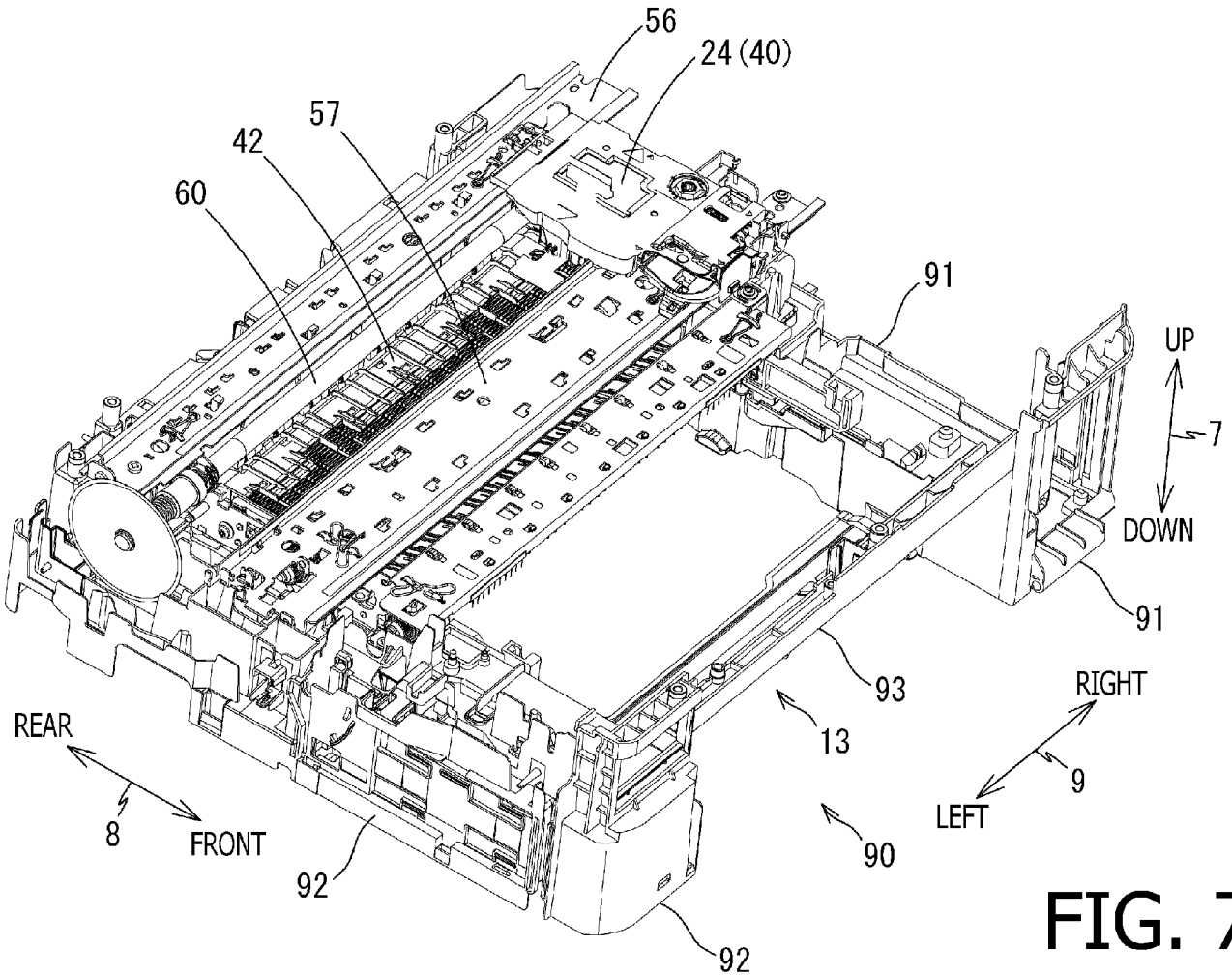

FIG. 7 is a perspective view of the base member 90, accompanied with guide rails 56, 57 and a recording unit 24, in the MFD 10 according to the embodiment of the present disclosure.

Figure 8A:
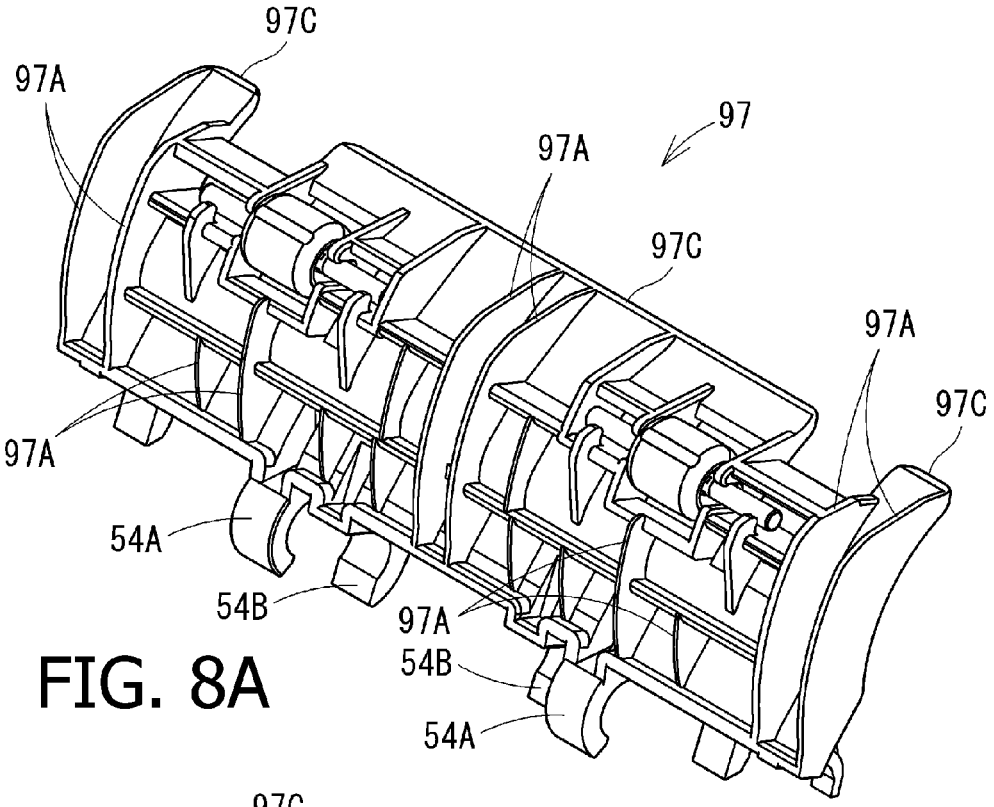
Figure 8B:
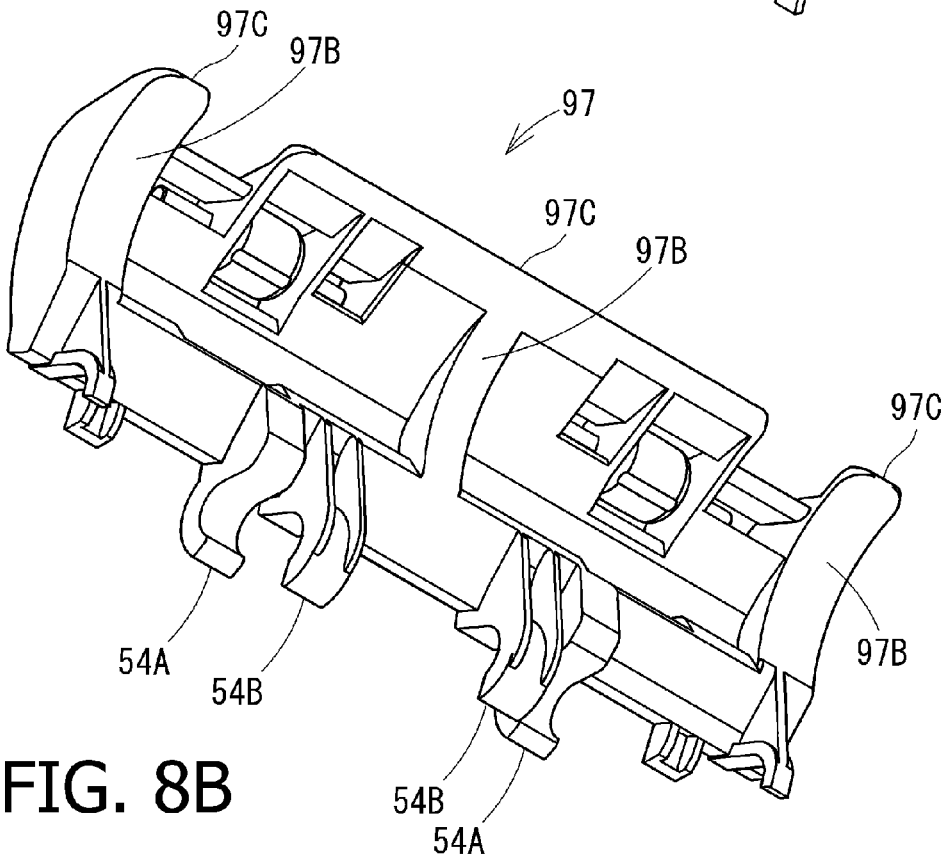

FIGS. 8A-8B are perspective views of the second flapper 97 in the MFD 10 according to the embodiment of the present disclosure.

Figure 9:
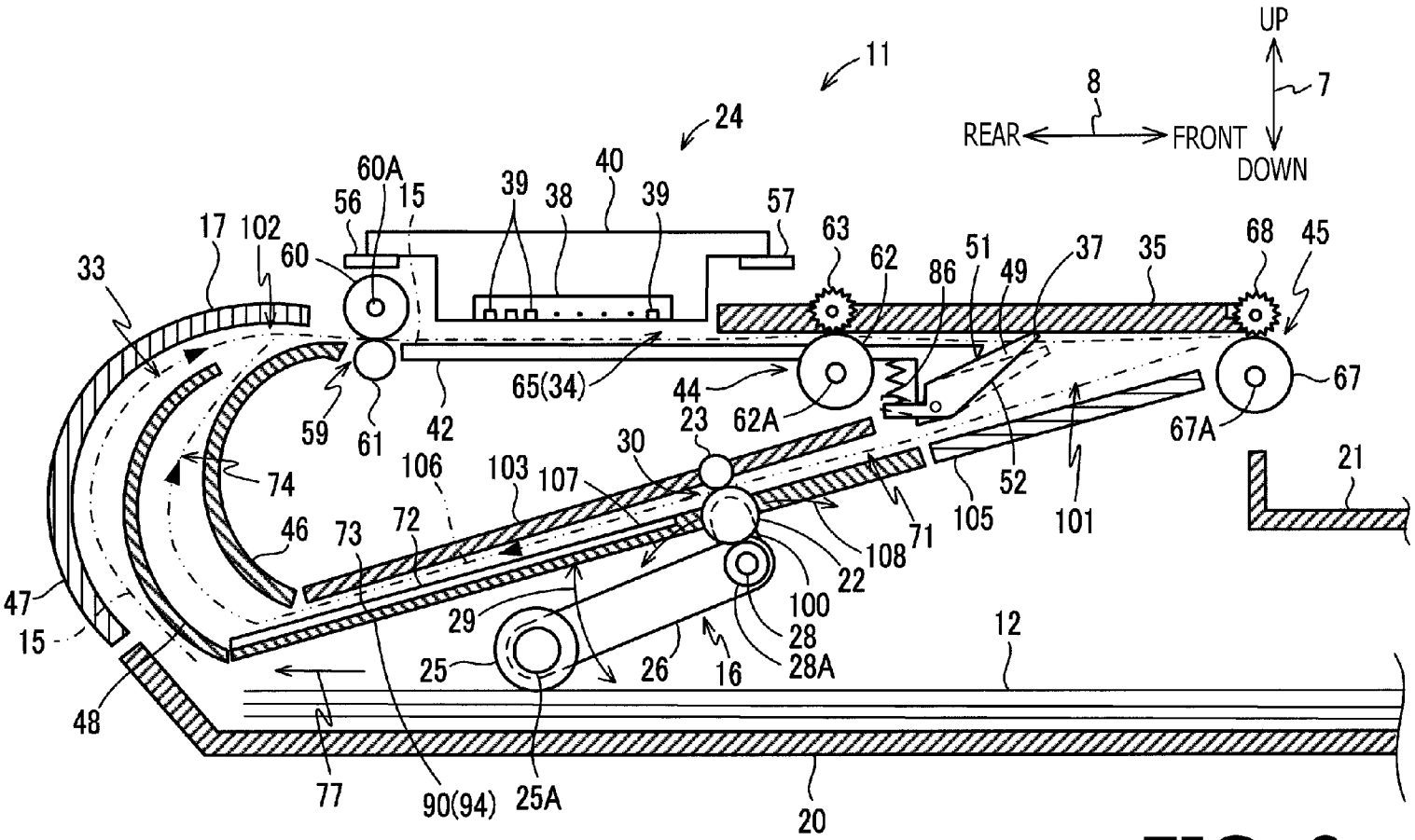

FIG. 9 is a cross-sectional side view of an internal structure of the printer 11 in the MFD 10 according to a modified example of the embodiment of the present disclosure.

Figure 10:
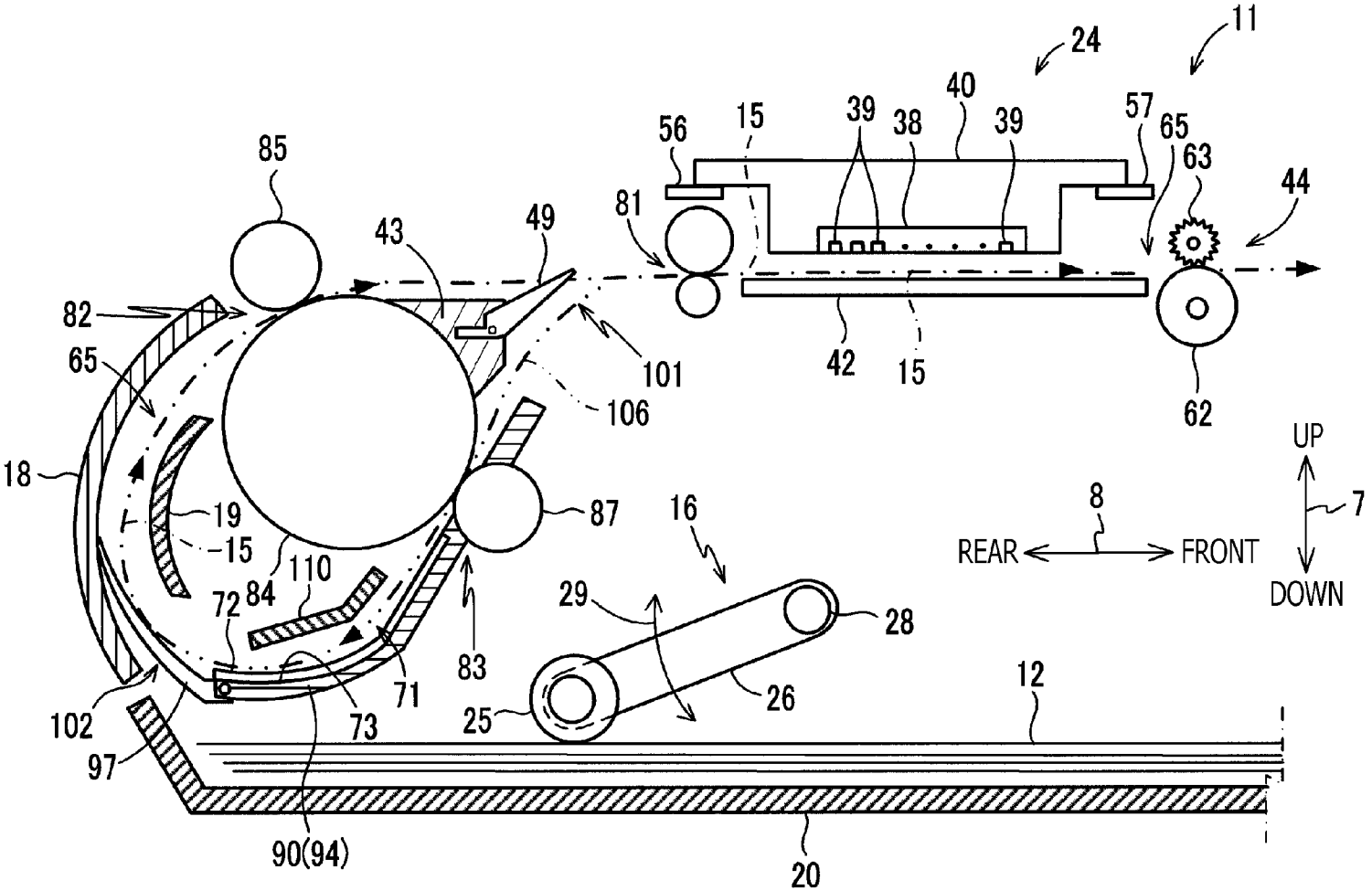

FIG. 10 is a cross-sectional side view of an internal structure of the printer 11 in the MFD 10 according to another modified example of the embodiment of the present disclosure.

DETAILED DESCRIPTION

Hereinafter, an embodiment according to the present disclosure will be described in detail with reference to the accompanying drawings. It is noted that various connections are set forth between elements in the following description. These connections in general and, unless specified otherwise, may be direct or indirect and that this specification is not intended to be limiting in this respect.

In the following description, a vertical direction 7 is defined with reference to an up-to-down or down-to-up direction for the MFD 10 in an ordinarily usable posture (see FIG. 1). In other words, the up-to-down or down-to-up direction in FIG. 1 coincides with the vertical direction 7. Further, other directions concerning the MFD 10 will be referred to based on the ordinarily usable posture of the MFD 10: a viewer's lower-right side in FIG. 1, on which an opening 13 is formed, is defined to be a front side of the MFD 10, and a side opposite from the front side, i.e., a viewer's upper-left side, is defined as a rear side of the MFD 10. A front-to-rear or rear-to-front direction is defined as a direction of depth and may be referred to as a front-rear direction 8. A lower-left side in FIG. 1, which comes on the user's left-hand side with respect to the MFD 10 when the user faces the front side, is referred to as a left side or a left-hand side. A side opposite from the left, which is on the viewer's upper-right side, is referred to as a right side or a right-hand side. A right-to-left or left-to-right direction of the MFD 10 may also be referred to as a right-left direction 9 or a widthwise direction 9. The directions shown in FIGS. 2-10 correspond to those indicated by the arrows appearing in FIG. 1.

[Overall Configuration of the MFD 10]

Figure 1:
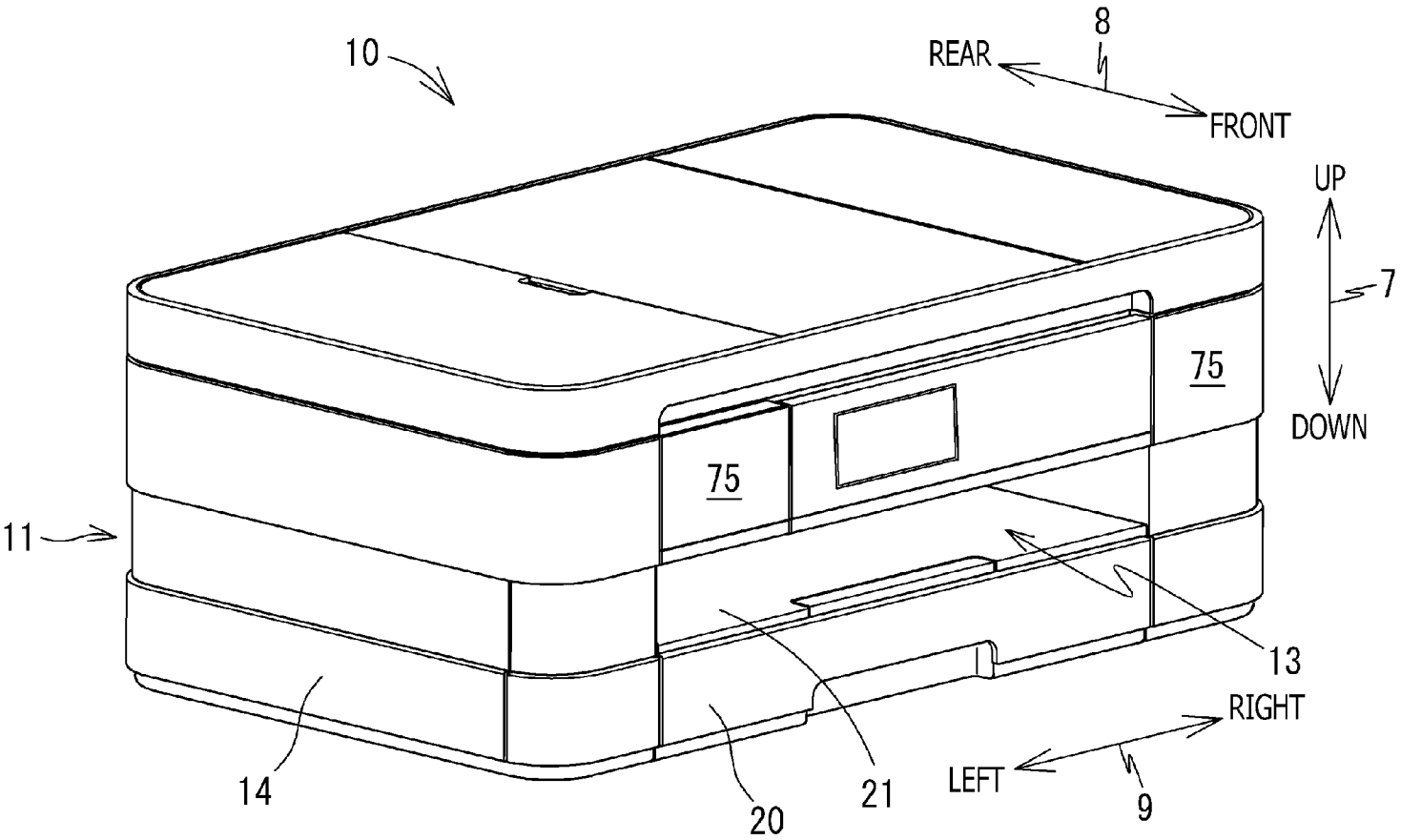
FIG. 1 is an external perspective view of a multifunction device (MFD) 10 according to an embodiment of the present disclosure.

As depicted in FIG. 1, the MFD 10 has an overall shape of a six-sided rectangular box and contains a printer 11, in which an image can be recorded on a recording sheet 12 (see FIG. 2) in an inkjet recording method, in a lower position thereof. In other words, the MFD 10 is equipped with a printing function. The MFD 10 is a multi-functional device having a plurality of functions, including, for example, a facsimile transmission/receiving function and a copier function, additionally to the printing function. The printer 11 is capable of recording an image on either side or both sides of the recording sheet 12 in, for example, an inkjet printing method. The method to record an image on the recording sheet 12 may not necessarily be limited to inkjet printing but may be, for example, an electro-photographic method.

Figure 2:
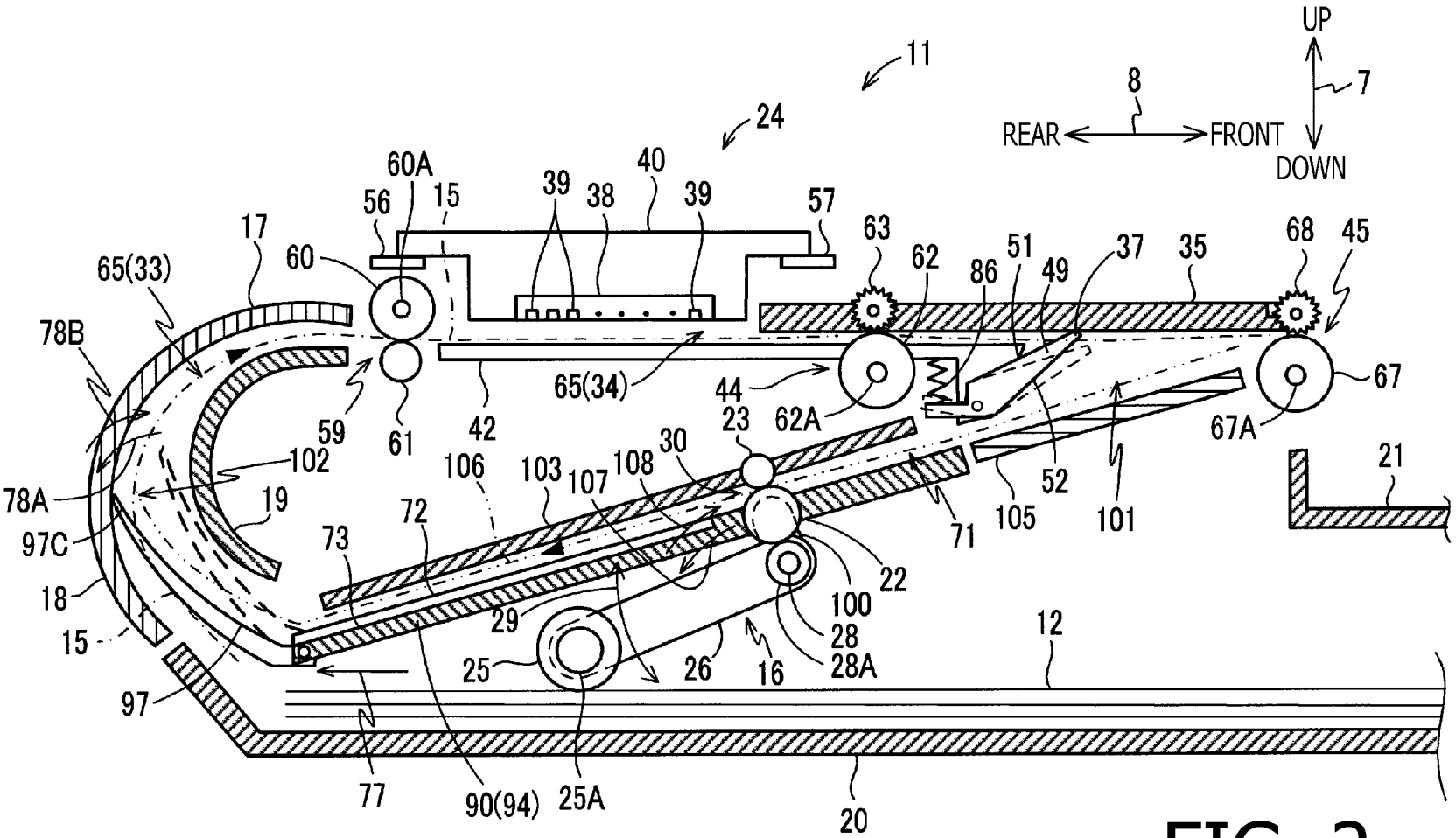
FIG. 2 is a cross-sectional side view of an internal structure of a printer 11 in the MFD 10 according to the embodiment of the present disclosure.

The printer 11 includes a chassis 14. On a front face 75 of the chassis 14, formed is the opening 13. As shown in FIG. 2, the chassis 14 contains a main conveyer path 65, an inverting path 71, guide rails 56, 57, and lateral frames 53 (see FIG. 8). The chassis 14 is an exterior cover, which may accommodate parts and components for the printer 11 therein, and is placed over a base member 90, which will be described later in detail.

[Feeder Tray 20]

As depicted in FIG. 1, a feeder tray 20 is installable in and removable from the chassis 14 through a lower area of the opening 13. As depicted in FIG. 2, the recording sheets 12 may be stored in and supported by the feeder tray 20. A sheet ejection tray 21 may be supported at an upper-frontward position in the feeder tray 20. On an upper plane of the sheet ejection tray 12, the recording sheets 12 with images formed thereon may be placed.

Figure 3:
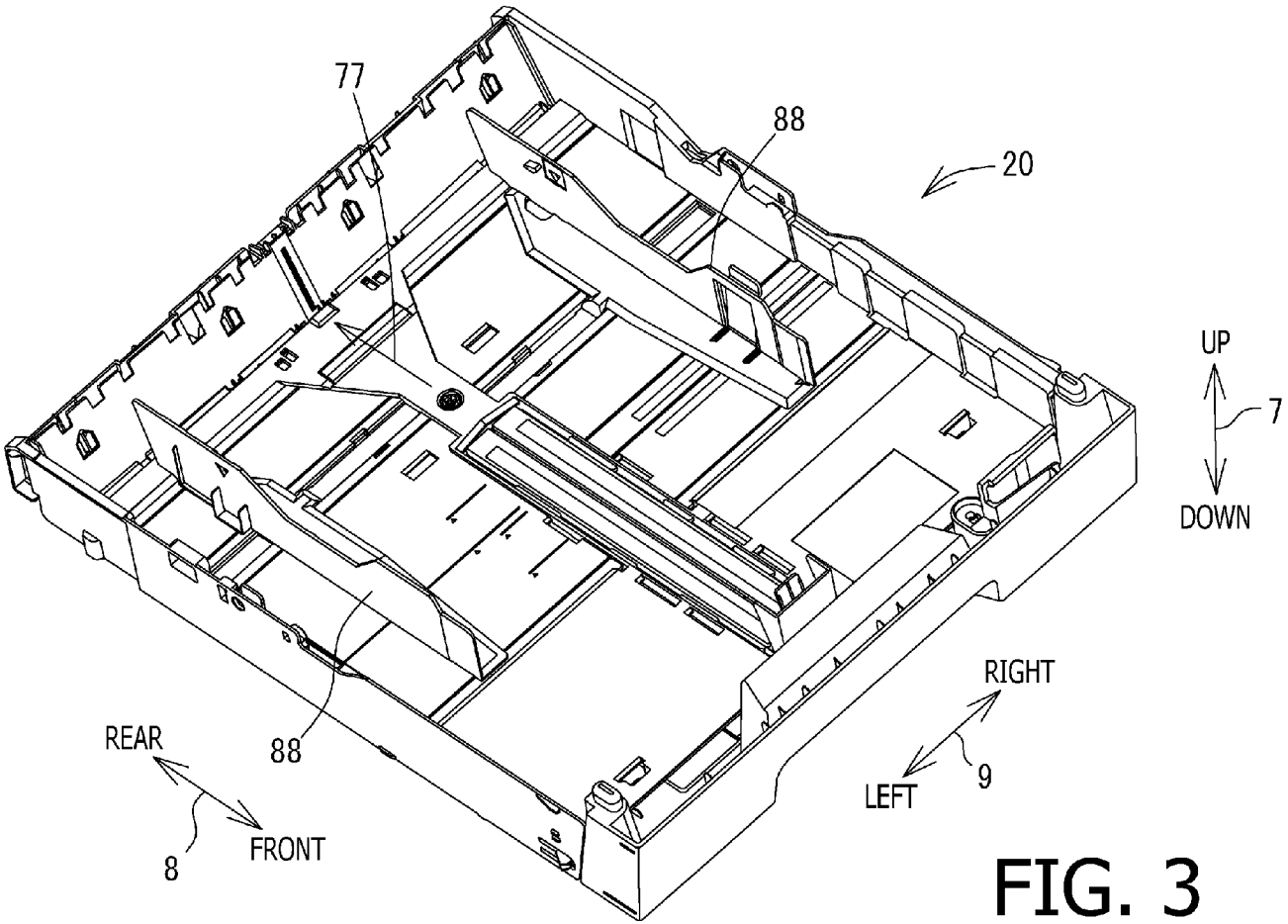
FIG. 3 is a perspective view of a feeder tray 20 in the MFD 10 according to the embodiment of the present disclosure.

As depicted in FIG. 3, a pair of edge guides 88 are arranged to face each other along the widthwise direction in the feeder tray 20. The pair of edge guides 88 are slidable in the widthwise direction 9 so that inward faces of the edge guides 88 may contact widthwise edges of the recording sheet 12 in the feeder tray 20. The pair of edge guides 88 are movable in a way such that, when one of the edge guides 88 moves in one direction along the widthwise direction 9, the other one of the edge guides 88 is moved in an opposite direction along the widthwise direction 9. Therefore, by placing the inward faces of the edge guides 88 to contact the widthwise edges of the recording sheet 12, the recording sheet 12 may be placed in a correct position in the widthwise direction 9 in the feeder tray 20.

The recording sheet 12 placed in the correct position with regard to the widthwise direction 9 may be supported on the feeder tray 20 and conveyed through a main conveyer path 65 and an inverting path 71, which will be described later in detail, to have an image recorded on a surface thereof in the recording unit 24. When the recording sheet 12 is placed in the correct position by the pair of edge guides 88, a widthwise center of the recording sheet 12 aligns with a predetermined reference position. In other words, the recording sheet 12 is centered at the predetermined reference position. Therefore, regardless of a size of the recording sheet 12, as long as the size of the recording sheet 12 is acceptable to the printer 11, a widthwise center of each recording sheet 12 stays on a line to travel through the main conveyer path 65 and the inverting path 71. In other words, the edge guides 88 place the widthwise center of the recording sheet 12 to align with the predetermined reference position.

[Feeder Unit 16]

As depicted in FIG. 2, a feeder unit 16 is arranged in an upper position with respect to the feeder tray 20 in the chassis 14. The feeder unit 16 includes a feeder roller 25, a feeder arm 26, and a drive shaft 28.

The feeder roller 25 is rotatably attached to one end of the feeder arm 26. The feeder roller 25 is rotatable by a driving force generated in a conveyer motor (not shown). For example, the feeder roller 25 may be rotated in a normal direction to feed the recording sheets 12 being supported on the feeder tray 20 in a feeding direction 77, i.e., rearward, by the driving force when the driving force is transmitted to the feeder roller 25. The recording sheet 12 conveyed in the feeding direction 7 by the feeder roller 25 is fed to a curved path 33, which is a part of the main conveyer path 65.

The feeder arm 26 is pivotable about the drive shaft 28 upward and downward, along a direction indicated by an arrow 29, to be closer to or farther from the recording sheets 12 placed on the feeder tray 20. The feeder arm 26 is pivotably supported at one end thereof on an upstream side with regard to the feeding direction 77 by the drive shaft 28, which is supported by the base member 90. The feeder arm 26 is arranged to longitudinally extend from the end thereof on the upstream side with regard to the feeding direction 77 to incline lower-rearward. The feeder arm 26 is urged downward due to the effect of gravity and/or resilient force provided by, for example, a spring.

Thus, the feeder arm 26 is pivotably supported by the base member 90 through the drive shaft 28 at the one end on the upstream side with regard to the feeding direction 77 and supports the feeder roller 25 rotatably at the other end on a downstream side with regard to the feeding direction 77.

The feeder unit 16 includes a gear 28A, a gear 25A, and a gear train (not shown). The gear 28A is rotatable integrally and coaxially with the drive shaft 28, and the gear 25A is rotatable integrally and coaxially with the feeder roller 25. The gear train is arranged between the gear 28A and the gear 25A and is rotatably supported by the feeder arm 26. The driving force from the motor is transmitted to the drive shaft 28 to rotate the drive shaft 28. The rotation of the drive shaft 28 is transmitted to the gear 25A through the gear 28A and the gear train to rotate the feeder roller 25. Thus, the feeder roller 25 is rotated by the rotation of the drive shaft 28.

[Main Conveyer Path 65]

As depicted in FIG. 2, the main conveyer path 65 is formed in the chassis 14 to extend from a rearward end of the feeder tray 20. The main conveyer path 65 includes the curved path 33 and a linear path 34. The curved path 33 is formed to curve upward from the rearward end of the feeder tray 20 and is connected with the linear path 34 at a rearward position with respect to a conveyer roller pair 59, which will be described later in detail. The linear path 34 is formed to extend from the position, at which the curved path 33 and the linear path 34 are connected with each other, to a reversible roller pair 45, which will be described later in detail, along the front-rear direction 8.

The curved path 33 includes a merging point 102, which will be described in detail later. The merging point 102 is a position, at which the inverting path 71 merges with the main conveyer path 65. The inverting path 71 will be described later in detail. The curved path 33 forms a part of the main conveyer path 65 at an area that includes the merging point 102. Meanwhile, the linear path 34 includes a branch point 101, which will be described in detail later. The linear path 34 forms a part of the main conveyer path 65 at an area that includes the branch point 101.

A form of the curved path 33 is defined by an outer guide member 18 and an inner guide member 19, which are spaced apart from each other for a predetermined amount of clearance to face each other along the front-rear direction 8. The linear path 34 is formed at a position corresponding to the recording unit 24, and a form of a part of the linear path 34 is defined by the recording unit 24 and a platen 42, which are spaced apart from each other for a predetermined amount of clearance to face each other along the vertical direction 7. Further, at a frontward position with respect to the recording unit 24, a form of another part of the linear path 34 is defined by a first upper guide member 35, the platen 42, an ejection roller 62, a spur roller 63, a first flapper 49, a reversible roller 67, and a spur roller 68. The first upper guide member 35 and the platen 42, the ejection roller 62 and the spur roller 63, the first upper guide member 35 and the first flapper 49, and the reversible roller 67 and the spur roller 68 are respectively arranged to face with each other. The first upper guide member 35 and the platen 42, and the first upper guide member 35 and the first flapper 49 are respectively arranged to be spaced apart from each other. Thus, the above-described mutually facing members and parts form at least a part of the main conveyer path 65.

The recording sheets 12 placed on the feeder tray 20 are fed by the feeder roller 25 to the curved path 33 and conveyed through the curved path 33 and the linear path 34 along a main conveying direction 15, which is indicated by a dotted line in FIG. 2. In other words, the feeder roller 25 conveys the recording sheets 12 supported on the feeder tray 20 along the main conveyer path 65 in the main conveying direction 15.

[Recording Unit 24]

As depicted in FIG. 2, the recording unit 24 is disposed in an upper position with respect to the linear path 34. In a lower position with respect to the linear path 34, and in a position to face with the recording unit 24 and the first upper guide member 35, disposed is the platen 42, which supports the recording sheet 12 in the main conveyer path 65. The platen 42 is supported by the pair of lateral frames 53 (see FIG. 6).

The recording unit 24 includes a carriage 40 and a recording head 38. The carriage 23 is movable along the widthwise direction 9 on the guide rails 56, 57 (see FIG. 7), which are arranged to be spaced apart from each other along the front-rear direction 8.

The guide rails 56, 57 are made of metal, such as stainless steel, and are each formed in a shape of a flat bar elongated along the widthwise direction 9, which intersects with the main conveying direction 15. The guide rails 56, 57 are supported by the pair of lateral frames 53, at widthwise ends thereof.

The pair of lateral frames 53 are made of metal, such as stainless steel, and are each formed in a shape of a plate spreading along the main conveying direction 15, i.e., along the front-rear direction 8. The lateral frames 53 are arranged on rightward and leftward positions of a conveyable range, in which the recording sheets 12 in various sizes may be conveyed, in the linear path 34. In other words, the lateral frames 53 are arranged on both widthwise sides of the main conveyer path 65.

The recording head 38 is mounted on the carriage 40. On a bottom plane of the recording head 38, formed are a plurality of nozzles 39. As ink is supplied to the recording head 38 from an ink cartridge (not shown), the recording head 38 discharges minute droplets of the ink through the nozzles 39. As the carriage 40 moves in the widthwise direction 9, the recording head 38 discharges the ink droplets at the recording sheet 12, which is conveyed by the feeder roller 25 and a conveyer roller 60 and is supported by the platen 42. Thus, an image is formed in the ink on the recording sheet 12. The conveyer roller 60 will be described later in detail.

[Conveyer Roller Pair 59, Ejection Roller Pair 44, and Reversible Roller Pair 45]

As depicted in FIG. 2, the conveyer roller pair 59 is disposed at a position in the linear path 34 on an upstream side of the recording unit 24 and on a downstream side of the merging point 102 with regard to the main conveying direction 15. The ejection roller pair 44 is disposed at a position in the linear path 34 on the downstream side of the recording unit 24 with regard to the main conveying direction 15. The reversible roller pair 45 is disposed at a position in the linear path 34 on a downstream side of the branch point 101 with regard to the main conveying direction 15.

The conveyer roller pair 59 includes the above-mentioned conveyer roller 60, which is disposed on an upper side of the linear path 34, and a pinch roller 61, which is disposed on a lower side of the linear path 34 to face with the conveyer roller 60. The ejection roller pair 44 includes an ejection roller 62, which is disposed on the lower side of the linear path 34, and a spur roller 63, which is disposed on the upper side of the linear path 34 to face with the ejection roller 62. The reversible roller pair 45 includes the reversible roller 67, which is disposed on the lower side of the linear path 34, and the spur roller 68, which is disposed on the upper side of the linear path 34 to face with the reversible roller 67.

The pinch roller 61 is urged toward the conveyer roller 60 by an urging member (not shown) such as a coil spring. The ejection roller 62 is urged toward the spur roller 63 by an urging member (not shown) such as a coil spring. The reversible roller 67 is urged toward the spur roller 68 by an urging member (not shown) such as a coil spring. Thus, the conveyer roller pair 59, the ejection roller pair 44, and the reversible roller pair 45 can nip the recording sheet 12 in the main conveyer path 65.

The conveyer roller 60, the ejection roller 62, and the reversible roller 67 are rotatably supported by the pair of lateral frames 53. The conveyer roller 60, the ejection roller 62, and the reversible roller 67 are driven by the driving force from the motor. When the motor is in normal rotation, the conveyer roller 60, the ejection roller 62, and the reversible roller 67 rotate in a normal direction, and when the motor is in reverse rotation, the conveyer roller 60, the ejection roller 62, and the reversible roller 67 rotate in a reverse direction.

The pinch roller 61, the spur roller 63, and the spur roller 68 are rotated by the rotation of the conveyer roller 60, the ejection roller 62, and the reversible roller 67, respectively.

While the recording sheet 12 is nipped by one or more of the conveyer roller pair 59, the ejection roller pair 44, and the reversible roller pair 45, and when the conveyer roller 60, the ejection roller 62, and the reversible roller 67 rotate in the normal direction, the recording sheet 12 is conveyed in the main conveying direction 15. On the other hand, when the conveyer roller 60, the ejection roller 62, and the reversible roller 67 rotate in the reverse direction, the nipped recording sheet 12 is conveyed in a reverse direction opposite from the main conveying direction 15.

[Inverting Path 71]

As depicted in FIG. 2, the inverting path 71 is formed in a lower position with respect to the linear path 34 and an upper position with respect to the feeder roller 25. The inverting path 71 is branched from the linear path 34 at the branch point 101, which is on the downstream side of the ejection roller pair 44 and on the upstream side of the reversible roller pair 45 with regard to the main conveying direction 15. More specifically, the inverting path 71 may be formed to branch from the liner path 34 to extend on a side of the platen 42 (e.g., downward) rather than a side of the first upper guide member 35 (e.g., upward), with regard to the vertical direction 7, along which the first upper guide 35 and the platen 42 face each other.

In the inverting path 71, the recording sheet 12 is conveyed in an inverting direction 106, which is indicated by a double-dotted arrow in FIG. 2, from the branch point 101 toward the merging point 102.

The inverting path 71 is merged with the curved path 33 at the merging point 102, which is on the upstream side of the conveyer roller pair 59 with regard to the main conveying direction 15. A form of the inverting path 71 is defined by the first flapper 49, a lower guide member 105, a second upper guide member 103, the base member 90, an inner guide member 19, and a second flapper 97. The first flapper 49 and the lower guide member 105, the second upper guide member 103 and the base member 90, and the inner guide member 19 and the second flapper 97, are respectively arranged to face each other and to be spaced apart from each other.

The first flapper 49, the second upper guide member 103, and the inner guide member 19 define a form of an upper side of the inverting path 71. The lower guide member 105, the base member 90, and the second flapper 97 define a form of a lower side of the inverting path 71. The first flapper 49 is disposed in a position on an upstream side of the second upper guide member 103 with regard to the inverting direction 106. The second upper guide member 103 is disposed in a position on an upstream side of the inner guide member 19 with regard to the inverting direction 106. The lower guide member 105 is disposed in a position on an upstream side of the base member 90 with regard to the inverting direction 106. The base member 90 is disposed in a position on an upstream side of the second flapper 97 with regard to the inverting direction 106.

The recording sheet 12 conveyed by a return-conveyer unit 31, which will be described below in detail, through the inverting path 71 in the second conveying direction 106 is further conveyed beyond the merging point 102 through the curved path 33 in the main conveying direction 15 to reach the conveyer roller pair 59. In other words, the inverting path 71 is a path to direct the recording sheet 12 from an upstream in the main conveying direction 15 toward the conveyer roller 60 through the curved path 33.

The merging point 102 is arranged between an upstream end and a downstream end of the curved path 33 with regard to the main conveying direction 15. Therefore, a curvature radius of a path, in which the recording sheet 12 travels from the inverting path 71 to the conveyer roller 60 through the curved path 33, is smaller than a curvature radius of a path, in which the recording sheet 12 travels from the feeder tray 20 to the conveyer roller 60 through the curved path 33.

[Return-Conveyer Unit 31]

The return-conveyer unit 31 includes, as depicted in FIG. 2, a return-conveyer roller pair 30, a return-conveyer arm 100, and the drive shaft 28.

The return-conveyer roller pair 30 is disposed along the inverting path 71. The return-conveyer roller pair 30 includes a return-conveyer roller 22, which is disposed on a lower side of the inverting path 71, and a driven roller 23, which is disposed on an upper side of the inverting path 71 to face with the return-conveyer roller 22. The driven roller 23 is rotated by rotation of the return-conveyer roller 22.

The return-conveyer arm 100 is pivotably supported by the drive shaft 28 at one end on the upstream side with regard to the inverting direction 106. Therefore, the return-conveyer arm 100 is pivotable about the drive shaft 28 in a direction 107 and a direction 108. When the drive shaft 28 rotates in the direction 107, the return-conveyer roller 22 is separated away from the driven roller 23, and when the drive shaft 28 rotates in the direction 108, the return-conveyer roller 22 is moved to be closer to the driven roller 23. The return-conveyer arm 100 is arranged to longitudinally extend from the end thereof on the upstream side with regard to the inverting direction 106 to incline upper-rearward. The return-conveyer arm 100 supports the return-conveyer roller 22 rotatably at the other end on a downstream side with regard to the inverting direction 106.

The return-conveyer arm 100 is urged by an urging member (not shown), which may include, for example, a torsion spring, in the direction 108 so that the return-conveyer roller 22 contacts the driven roller 23. Thus, the return-conveyer roller pair 30 may nip the recording sheet 12 in the inverting path 71.

The return-conveyer roller 22 is rotated in a normal direction by the driving force transmitted from the motor. The return-conveyer roller pair 30, including the return-conveyer roller 22 rotating in the normal direction, nips the recording sheet 12 and conveys the nipped recording sheet 12 in the inverting direction 106 along the inverting path 71. The return-conveyer unit 31 may include, for example, a first gear (not shown), which may be rotatable integrally and coaxially with the drive shaft 28, and a second gear (not shown), which may be rotatable integrally and coaxially with the return-conveyer roller 22 and may be engaged with the first gear directly or indirectly through another gear. The driving force from the motor may be transmitted through the drive shaft 28 to the first gear, and through the first gear and the second gear to the return-conveyer roller 22 to rotate the return-conveyer roller 22. In other words, the return-conveyer roller 22 may convey the recording sheet 12 in the inverting direction 106 by the rotation of the drive shaft 28.

[Drive-Force Transmission System]

The printer 11 includes a drive-force transmission system, which is not shown. The drive-force transmission system transmits the driving force generated in the motor to movable parts, which include the feeder roller 25, the conveyer roller 60, the ejection roller 62, the reversible roller 67, and the return-conveyer roller 22. The drive-force transmission system may include one or more of a gear, a pulley, an endless belt, a planet-gear system including a pendulum-gear system, and a one-way clutch. Meanwhile, the motor to drive the feeder roller 25, the conveyer roller 60, the ejection roller 62, the reversible roller 67, and the return-conveyer roller 22 may not necessarily be limited to a single motor but may include a plurality of motors.

[First Flapper 49]

As depicted in FIG. 2, the first flapper 49 is disposed in the linear path 34 between the ejection roller pair 44 and the reversible roller pair 45. The first flapper 49 is disposed, in particular, at the branch point 101. The first flapper 49 may be arranged to face with the first upper guide member 35 along the vertical direction 7.

The first flapper 49 is supported by the platen 42 to be pivotable between a first condition, which is indicated by solid lines in FIG. 2, and a second condition, which is indicated by broken lines in FIG. 2. When in the first condition, the flapper 49 may contact the first upper guide member 35 to close the main conveyer path 65. The first flapper 49 in the second condition is in a lower position with respect to the first flapper 49 in the first condition, and when in the second condition, the flapper 49 may be separated from the first upper guide member 35 to form a clearance between the flapper 49 and the first upper guide member 35 so that the recording sheet 12 being conveyed in the main conveying direction 12 is allowed to pass through the clearance. A pivotable end, or a frontward end 37, of the first flapper 49 in the second condition is in a lower position with respect to the frontward end 37 of the first flapper 49 in the first condition. The first flapper 49 may not necessarily be supported by the platen 42 but may be pivotably supported by another member, such as a frame (not shown) of the printer 11.

As depicted in FIG. 2, the first flapper 49 is urged by a coil spring 86 to place the frontward end 37 upward. The coil spring 86 is coupled to the first flapper 49 at one end and to the platen 42 at the other end. The first flapper 49 being urged by the coil spring 86 may be in the first condition, in which the frontward end 37 thereof may contact the first upper guide member 35. According to the present embodiment, the first flapper 49 is in the first condition when the coil spring 86 urges the first flapper 49 and when no other force from any parts or components in the printer 11 is applied to the first flapper 49.

[Base Member 90]

The base member 90 forms a lower part of the printer 11 and may be made integrally of resin, such as poly butylene terephthalate (PBT) and acrylonitrile butadiene styrene (ABS).

Figure 4:
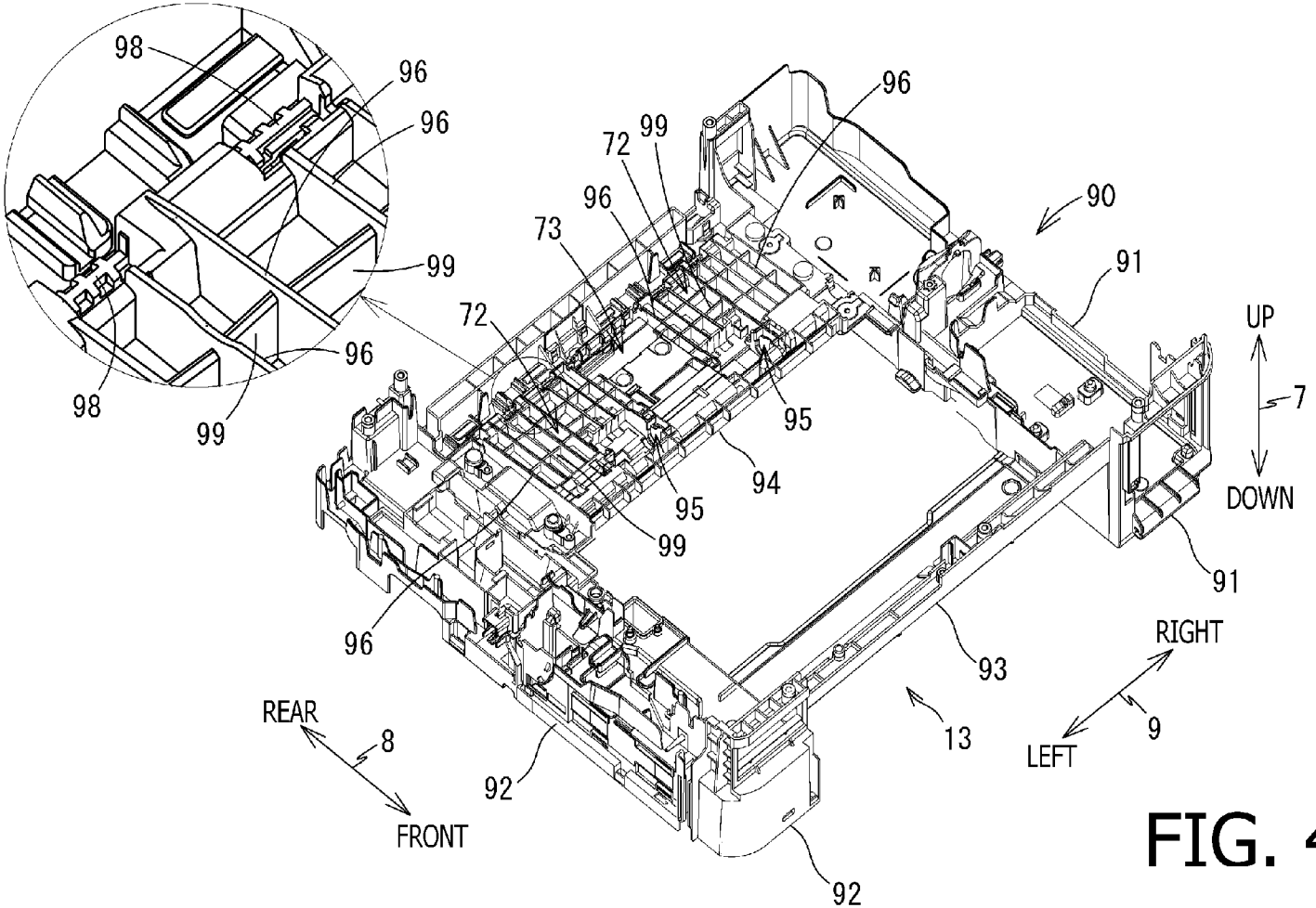
FIG. 4 is a perspective view of a base member 90 in the MFD 10 according to the embodiment of the present disclosure.

As depicted in FIG. 4, the base member 90 includes a rightward section 91, a leftward section 92, a frontward section 93, and a rearward section 94. The rightward section 91 forms a lower-rightward part of the printer 11. The leftward section 92 forms a lower-leftward part of the printer 11. The frontward section 93 connects frontward ends of the rightward section 91 and the leftward section 92. The rearward section 94 connects rearward ends of the rightward section 91 and the leftward section 92.

Bottoms of the rightward section 91 and the leftward section form a bottom plane of the MFD 10, by which the MFD 10 may be placed on, for example, a desktop.

On a front side of the rearward section 94, formed are through-holes 95, which are open in the widthwise direction 9. In the through-holes 95, the drive shaft 28 is inserted (see FIG. 5). Thus, the drive shaft 28 is rotatably supported by the rearward section 94 through bearings (not shown). In other words, the drive shaft 28 is rotatably supported by the base member 90. Meanwhile, as has been described above, the drive shaft 28 supports the feeder roller 25 through the feeder arm 26. Further, the drive shaft 28 supports the reverse-conveyer roller 22 through the return-conveyer arm 100. Therefore, the base member 90 supports the feeder arm 26, the feeder roller 25, the return-conveyer arm 100, and the return-conveyer roller 22 through the drive shaft 28. Further, as depicted in FIG. 5, the base member 90 supports the outer guide member 18 at a rearward position with respect to the rearward section 94.

As depicted in FIG. 4, on an upper side of the rearward section 94, formed are a plurality of ribs 96, which are spaced apart from one another across the widthwise direction 9 and elongated along the inverting direction 106. The ribs 96 are arranged in a lower position with respect to the second upper guide member 103 to face with the second upper guide member 103 along the vertical direction 7. A virtual surface spreading on protrusive edges of the ribs 96 defines a form of part of a bottom of the inverting path 71. In particular, the virtual surface defines the form of the bottom of the inverting path 71 at downstream side of the lower guide member 105 with regard to the inverting direction 106. In other words, the virtual surface guides the recording sheet 12 on the ribs 96 along the inverting path 71. The ribs 96 are reinforced by ribs 99, which are formed to be shorter than the ribs 96 and elongated through the ribs 96 along the widthwise direction 9.

As depicted in FIG. 6, the rightward section 91 supports one of the paired lateral frames 53 on the right, and the leftward section 91 supports the other one of the paired lateral frame 53 on the left. Meanwhile, as has been described above, the paired lateral frames 53 support the recording unit 24 through the guide rails 56, 57; the platen 42; and the conveyer roller 60, the ejection roller 62, and the reversible roller 67 rotatably. In other words, the base member 90 supports the recording unit 24, the platen 42, and the rollers including the conveyer roller 60, the ejection roller 62, the reversible roller 67, the feeder roller 25, and the return-conveyer roller 22.

[Second Flapper 97]

As depicted in FIGS. 2 and 5, the printer 11 includes a second flapper 97. The second flapper 97 is disposed at the merging point 102. The rearward section 94 in the base member 90 supports the second flapper 97 at a rear end thereof pivotably so that the second flapper 97 is pivotable in directions indicated by an arrow 78A and an arrow 78B. The arrow 78A indicates a direction, in which the second flapper 97 pivots to be closer to the outer guide member 18. The arrow 78B indicate a direction, in which the second flapper 97 pivots to be closer to the inner guide member 19.

The second flapper 97 is supported by the rearward section 94. More specifically, as depicted in FIG. 4, on the rear end of the rearward section 94, formed is a shaft 98, which is elongated along the widthwise direction 9. Meanwhile, as depicted in FIGS. 8A-8B, the second flapper 97 is formed to have a first protrusive claw 54A and a second protrusive claw 54B. The first protrusive claw 54A and the second protrusive claw 54B are formed to protrude to curve from an edge of the second flapper 97 on an upstream side with regard to the inverting direction 106 and are arranged to interpose the shaft 98 in there-between along the front-rear direction 8. With the shaft 98 thus being clutched by the first protrusive claw 57 and the second protrusive claw, the second flapper 97 is pivotably supported by the base member 90.

As depicted in FIG. 2, the second flapper 97 is, when the second flapper 97 is supported by the base member 90, formed to curve so that a rearward face is on an outer side of the curvature and a frontward face is on an inner side of the curvature. As depicted in FIG. 8A, on an outward face of the second flapper 97, formed are a plurality of ribs 97A, which are spaced apart from one another across the widthwise direction 9. The ribs 97A stretch to curve similarly to a surface of the outer guide member 18 on the side of the curved path 33. As depicted in FIG. 8B, at a widthwise center and widthwise ends of the second flapper 97 on an inward face on the inner side of the curve, formed are curved surfaces 97B, which curve similarly to a surface of the inner guide member 19 on the side of the curved path 33.

The second flapper 97 is movable to pivot between a first position, which is indicated by solid lines in FIG. 2, and a second position, which is indicated by broken lines in FIG. 2. The second flapper 97 in the first position and the inner guide member 19 face each other across a predetermined amount of clearance. In this regard, the curved surfaces 97B and the outer side of the curve of the inner guide member 19 define a form of a part of the inverting path 71. Meanwhile, the second flapper 97 in the second position and the outer guide member 18 face each other across a predetermined amount of clearance. In this regard, a virtual surface spreading on protrusive edges of the ribs 97A and the inner surface of the curve of the outer guide member 18 define a form of a part of the curved path 33.

As depicted in FIG. 2, the second flapper 97 is, when no force from any parts or components in the printer 11 is applied to the second flapper 97, maintained at the first position by itself due to the effect of gravity. In the meantime, a pivotable end 97C of the second flapper 97 in the first position contacts the outer guide member 18.

[Rearward Section 94]

As depicted in FIGS. 2, 4, and 5, an upper side of the rearward section 94 includes a first guiding plane 72 and a second guiding plane 73. The first guiding plane 72 is a virtual plane which spreads on the protrusive edges of the ribs 96. The second guiding plane 73 forms a part of an upper plane of the rearward section 94 and is located in a lower position with respect to the protrusive edges of the ribs 96.

The first guiding plane 72 defines a form of a part of a lower side of the inverting path 71. The lower side of the inverting path 71 is continuous with an outer side of the curved path 33. Meanwhile, the inverting path 71 is on an upstream side of the curved path 33 with regard to the inverting direction 106. Therefore, the first guiding plane 72 defines the form of the inverting path 71 on the upstream side of the curved path 33 with regard to the inverting direction 106 on the same side as the outer guide member 18, which defines the form of the outer side of the curved path 33.

The second guiding plane 73, similarly to the first guiding plane 73, defines a form of a part of the lower side of the inverting path 71. The second guiding plane 73 is arranged to adjoin the first guiding plane 72 along the widthwise direction 9 but is formed in a lower position than the first guiding plane 72 with regard to the vertical direction 7. In other words, the second guiding plane 73 is formed on the upper side of the rearward section 94 to dent with respect to the first guiding plane 72 to be farther from the second upper guide member 103, which faces with the rearward section 94 across the inverting path 71. Therefore, the upper side of the rearward section 94 is formed to dent at the position of the second guiding plane 73. In this regard, an amount (depth) of the dent of the second guiding plane 73 with respect to the first guiding plane 72 may be constant.

While the second guiding plane 73 is in the lower position than the first guiding plane 72, a curvature radius of a path for the recording sheet 12 that travels along the second guiding plane 73 and the outer guide member 18 is larger than a curvature radius of a path for the recording sheet 12 that travels along the first guiding plane 72 and the outer guide member 18.

The first guiding plane 73 is extended to the curved surfaces 97B (see FIGS. 8A-8B) of the second flapper 97 in the first position. In other words, the second guiding plane 73 continuously aligns with the curved surfaces 97B along the inverting direction 106. It may be preferable that the second guiding plane 73 is connected with the curved surfaces 97B without a gap there-between. However, there may be a gap between the second guiding plane 73 and the curved surfaces 97B.

As depicted in FIG. 5, the second guiding plane 73 may be, but may not necessarily be limited to, arranged on a downstream side of the return-conveyer roller 22 with regard to the inverting direction 106 and on a downstream side of a supporting position (unsigned), where the base member 90 supports the feeder arm 26, with regard to the inverting direction 106. In this regard, the second guiding plane 73 may be, but not necessarily, extended to an upstream side of the position of the drive shaft 28 with regard to the inverting direction 106.

As depicted in FIGS. 4 and 5, the second guiding plane 73 is arranged at a widthwise central area in the conveyable range for the recording sheet 12, in a position between two (2) pieces of first guiding plane 72. In particular, the second guiding plane 73 is arranged in a conveyable area for relatively rigid recording sheet 12, such as a postcard being more rigid than regular printing paper.

A dimension of the second guiding plane 73 in the widthwise direction 9 may be determined depending on a size of the recording sheet 12 to be guided by the second guiding plane 73. For example, when the dimension of the second guiding plane 73 is set to be larger than 89 mm, and a widthwise dimension of a recording sheet 12 to be conveyed is smaller than or equal to 89 mm, the recording sheet 12 conveyed on the second guiding plane 73 in the inverting direction 106 may be guided by the second guiding plane 73. On the other hand, when the widthwise dimension of the recording sheet 12 to be conveyed is greater than 89 mm, or when the widthwise dimension of the recording sheet 12 to be conveyed is greater than the widthwise dimension of the second guiding plane 73, the recording sheet 12 conveyed along the second guiding plane 73 in the inverting direction 106 may be guided by the first guiding planes 72 at the widthwise ends thereof. In this regard, the recording sheet 12 may be separated from the second guiding plane 73 at the widthwise central area to float over the second guiding plane 73.

[Behaviors to Record Images on Both Sides of the Recording Sheet 12]

Behaviors of the printer 11, when images are formed on both sides of the recording sheet 12 supported by the feeder tray 20, will be described below.

First, the feeder roller 25 rotates in the normal direction, and the recording sheet 12 on the feeder tray 20 is fed to the curved path 33.

Meanwhile, the second flapper 97 is maintained at the first position by itself due to the effect of gravity. Therefore, a leading end of the recording sheet 12 being conveyed to the curved path 33 contacts the second flapper 97. Further to the contact with the recording sheet 12, the second flapper 97 is pushed by the recording sheet 12 and pivots from the first position to the second position. In this regard, the ribs 97A of the second flapper 97 in the second position guide the recording sheet 12 in the main conveying direction 15 along the curved path 33 to the downstream side with respect to the merging point 102. As a tail end of the recording sheet 12 passes through the second flapper 97, the second flapper 97 pivots from the second position to the first position by itself due to the effect of gravity.

When the leading end of the recording sheet 12 guided along the curved path 33 reaches the conveyer roller pair 59, the recording sheet 12 is conveyed downstream with respect to the recording unit 24 by the conveyer roller pair 59 in the main conveying direction 15. Thereafter, while the recording sheet 12 is supported by the platen 42, an image is formed on a first side of the recording sheet 12.

The recording sheet 12, with the image formed on the first side thereof, is conveyed by the ejection roller pair 44 along the linear path 34 in the main conveying direction 12 and contacts an upper surface 51 of the first flapper 49 to push the first flapper 49. Thereby, the first flapper 49 pivots against the urging force of the coil spring 86 to be in the second condition.

The first flapper 49 in the second condition is pushed by the recording sheet 12 to be separated from the first upper guide member 35. The first flapper 49 stays at the position separated from the first upper guide member 35 until the tail end of the recording sheet 12 passes through the first flapper 49. Thereafter, as the tail end of the recording sheet 12 conveyed by the reversible roller 67 rotating in the normal direction passes through the first flapper 49, the first flapper 49 is moved to pivot to the first condition by the urging force of the coil spring 86.

If the reversible roller 67 continues to rotate in the normal direction, the reversible roller pair 45 conveys the recording sheet 12 in the main conveying direction 15 to eject the recording sheet 12 in the ejection tray 21. Meanwhile, if the rotation of the reversible roller 67 is switched from the normal rotation to the reverse rotation, the reversible roller pair 45 conveys the recording sheet 12 in the opposite direction from the main conveying direction 15. In this regard, the first flapper 49 is in the first condition to close the main conveyer path 65; therefore, the recording sheet 12 is guided along a lower surface 52 of the first flapper 49 to the inverting path 71. Thus, the first flapper 49 in the first condition guides the recording sheet 12, which is conveyed by the reversible roller pair 45 rotating in the reverse direction being the opposite direction from the main conveying direction 15.

As the directions to convey the recording sheet 12 switch, the former tail end (i.e., a rearward end) of the recording sheet 12 on the rear side now becomes a leading end, and the former leading end (i.e., a frontward end) of the recording sheet 12 on the front side now becomes a tail end in the inverting path 71. Thus, with the leading end on the rear side, when the recording sheet 12 is conveyed through the inverting path 71 and reenters the main conveyer path 65, the recording sheet 12 is inverted upside-down.

The recording sheet 12 is thus conveyed in the inverting direction 106 in the inverting path 71 by the return-conveyer roller pair 30 rotating in the normal direction to the second flapper 97 in the first position. The return-conveyer roller 22 conveys the recording sheet 12 reaching the second flapper 97 to exit the inverting path 71 and proceed beyond the merging point 102 to the curved path 33. In this regard, the curved surface 97B of the second flapper 97 in the first position guides the recording sheet 12 being conveyed by the return-conveyer roller 22 in the main conveying direction 15 to the main conveyer path 65.

As the recording sheet 12 conveyed in the curved path 33 reaches the conveyer roller pair 59, the recording sheet 12 is conveyed by the conveyer roller pair 59 in the main conveying direction 15 to reach the position below the recording unit 24. When the recording sheet 12 reaches the position below the recording unit 24, a second side of the recording sheet 12 faces with the recording unit 24 along the vertical direction 7 so that the recording unit 24 may record an image on the second side of the recording sheet 12. Thereafter, the recording sheet 12 with the images formed on the both sides thereof is conveyed by the ejection roller pair 44 and the reversible roller pair 45 to be ejected in the ejection tray 21. Thus, the recording sheet 12 may be inverted in the inverting path 71 and the main conveyer path 65 so that the recording sheet 12 may be conveyed in the inverting direction 106 to be directed to the main conveyer path 65 once again.

[Effects]

According to the embodiment described above, the second guiding plane 73 is formed in the position, where the relatively rigid smaller-sized recording sheet 12 such as a postcard travels; therefore, backlash which may be caused at the curved path 33 by the smaller-sized rigid sheet against the base member 90 may be reduced. Further, within the guiding plane that includes the first guiding plane 72 and the second guiding plane 73, the second guiding plane 73 is selectively dented so that rigidity of the base member 90 may be maintained. In other words, the rigidity of the base member 90 may be maintained, and at the same time, impact of the backlash against the base member 90 may be reduced.

According to the embodiment described above, the backlash from the recording sheet 12 may be caused to affect the base member 90 after the tail end of the recording sheet 12 is conveyed through the return-conveyer roller 22. Therefore, by forming the second guiding plane 73 on the downstream side of the return-conveyer roller 22, but not on the upstream side of the return-conveyer roller 22, with regard to the inverting direction 106, the rigidity of the base member 90 may be maintained while the impact of the backlash against the base member 90 may be reduced.

According to the embodiment described above, the second guiding plane 73 is formed on the downstream side of the supporting point, at which the base member 90 supports the feeder arm 26, with regard to the inverting direction 106. Therefore, the rigidity of the base member 90 at the supporting point to support the feeder arm 26 may be maintained. Accordingly, the impact of the backlash against the base member 90 may be reduced, and positional accuracy of the recording sheet 12 being conveyed by the feeder roller 25 may be prevented from lowering.

According to the embodiment described above, the feeder arm 26 and the return-conveyer arm 100 are supported by the same drive shaft 28. Therefore, the structure of the MFD 10 may be simplified and downsized.

According to the embodiment described above, the curved surfaces 97B of the second flapper 97 are arranged to continuously align with the second guiding plane 73. Therefore, the recording sheet 12 guided along the second guiding plane 73 may be smoothly forwarded to the main conveyer path 65.

According to the embodiment described above, the conveyer roller 60 is supported by the lateral frames 53. Therefore, the recording sheet 12 may be steadily conveyed to the recording unit 24. Accordingly, while an image recording quality may tend to be lowered by the base member 90 being made of resin, with the arrangement of the conveyer roller 60 supported by the lateral frames 53, the image recording quality may be restrained from being lowered.

According to the embodiment described above, the conveyer roller 60 and the guide rails 56, 57 are supported by the lateral frames 53 while the guide rails 56, 57 support the recording unit 24. Therefore, the positional relation between the conveyer roller 60 and the recording unit 24 may be maintained accurately. Accordingly, the image recording quality, which may tend to be lowered due to the base member 90 being made of resin, may be restrained from being lowered.

[Modified Examples]

Although an example of carrying out the invention has been described, those skilled in the art will appreciate that there are numerous variations and permutations of the image recording apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the depth of the second guiding plane 73 dented with respect to the first guiding plane 72 may not necessarily be constant but may be greater (deeper) toward the downstream and smaller (shallower) toward the upstream along the inverting direction 106. With this configuration, the rigidity of the base member 90 may be maintained while the impact of the backlash against the base member 90 may be reduced even more effectively.

For another example, the recording sheet 12 may not necessarily be guided by the edge guides 88 to be centered at a predetermined reference position but may be, for example, guided to align with a predetermined reference position at a rightward or leftward edge thereof. In this arrangement, the second guiding plane 73 may be arranged in the area, where the relatively rigid recording sheet 12 travels. Therefore, for example, the second guiding plane 73 may be arranged in a rightward or leftward area in the conveyable range for the recording sheet 12.

For example, the feeder roller 25 and the return-conveyer roller 22 may not necessarily be rotated by the rotation of the same drive shaft 28 but may be rotated by rotation of different drive shafts.

For another example, the recording sheet 12 in the inverting path 71 may not necessarily be guided on the plurality of ribs 96, which are formed on the upper side of the rearward section 94 of the base member 90. For example, no rib 96 may be formed on the upper side of the rearward section 94 of the base member 90, but the recording sheet 12 may be guided by an upper plain surface of the rearward section 94 in the inverting path 71. In other words, the upper surface of the rearward section 94 may include first guiding planes, which are formed in place of the first guiding plane 72, and a second guiding plane, which is formed in place of the ribs 96 to dent downward with respect to the first guiding plane.

For another example, the second guiding plane 73 may be configured with a plurality of ribs. In other words, the second guiding plane 73 may be a virtual plane spreading on protrusive edges of the plurality of ribs. The ribs may be arranged to be spaced apart from one another across the widthwise direction 9 and elongated along the inverting direction 106. In this regard, the protrusive edges of the ribs may be in lower positions than the first guiding plane 72.

For another example, the recording sheet 12 from the feeder tray 20 may not necessarily be guided in the curved path 33 by the plurality of ribs 97A, which are formed on the outward face on the outer side of the curve of the second flapper 97. For example, no rib 97A may be formed on the outward face on the outer side of the curve of the second flapper 97, but the recording sheet 12 may be guided by a plain outward face of the curve of the second flapper 97. In other words, the outward face of the curve of the second flapper 97 may guide the recording sheet 12 along the curved path 33.

For another example, the quantity of the curved surfaces 97B formed on the inner side of the curve of the second flapper 97 may not necessarily be three (3) but may be more or less. For another example, a plurality of ribs, which may be similar to the ribs 97A formed on the outward face on the outer side of the curve of the second flapper 97, may be formed on the inward face on the inner side of the curve of the second flapper 97.

For another example, the second flapper 97 may not necessarily be maintained at the first position by itself due to the effect of gravity when no force from any parts or components in the printer 11 is applied to the second flapper 97 but may be maintained at the first position by a force applied to the second flapper 97. For example, the second flapper 97 may be urged to the first position by an urging force from an urging member such as a coil spring.

For another example, the inverting path 71 may not necessarily merged with the main conveyer path 65 through the curved path 33 to convey the recording sheet 12 having been conveyed through the inverting path 71 in the inverting direction 106 to the conveyer roller pair 59 as long as the inverting path 71 guides the recording sheet 12 to the conveyer roller 60 through a curved path, which may be formed separately from the curved path 33.

For example, as depicted in FIG. 9, the inverting path 71 may include a curved path 74, which is formed separately from the curved path 33, to guide the recording sheet 12 to the conveyer roller pair 59. The curved path 74 may be arranged in a frontward position with respect to the curved path 33 and may be merged with the main conveyer path 65 at a position on an upstream side of the conveyer roller pair 59 with regard to the main conveying direction 15. A guide member 48 to define a form of an outer side of curvature of the curved path 74 and an inner side of the curvature of the curved path 33 may be arranged in a position between the curved path 74 and the curved path 33. A form of the curved path 74 may be defined by the guide member 48 and an inner guide member 46. Meanwhile, the form of the curved path 33 may be defined by the guide member 48 and an outer guide member 47.

In this configuration depicted in FIG. 9, a curvature radius of the curved path 74 is smaller than the curvature radius of the curved path 33. In this regard, the second guide face 73 may reduce the impact of the backlash from the recording sheet 12 against the base member 90.

For another example, the inverting path 71 may not necessarily be in the configuration described above or illustrated in FIG. 2 as long as the sides of the recording sheet 12 to face with the recording unit 24 are reversible.

For example, the branch point 101 may not necessarily be on the downstream side of the recording unit 24 with regard to the main conveying direction 15, or the merging point 102 may not necessarily be on the upstream side of the recording unit 24 with regard to the main conveying direction 15.

For another example, the inverting path may be in a configuration as depicted in FIG. 10. In FIG. 10, the branch point 101 and the merging point 102 may both be on the upstream side of the recording unit 24 in the main conveyer path 65 with regard to the main conveying direction 15. Meanwhile, the merging point 102 may be arranged on the upstream side of the branch point 101 in the main conveyer path 65 with regard to the main conveying direction 15.

Further, the first flapper 49 may be supported pivotably by the guide member 43 at the branch point 101. A first roller pair 81 may be arranged in a position between the first flapper 49 and the recording unit 24 in the main conveyer path 65, and a second roller pair 82 may be arranged on the upstream side of the first flapper 49 in the main conveyer path 65 with regard to the main conveying direction 15. Furthermore, a third roller pair 83 may be arranged in the inverting path 71. The second roller pair 82 may include an intermediate roller 84 and a first driven roller 85. The third roller pair 82 may include the intermediate roller 84, which is common with the second roller pair 82, and a second driven roller 87.

According to the example in FIG. 10, the form of the curved path 33 may be defined by the outer guide member 18 and the inner guide member 19. The form of the inverting path 71 may be at least partly defined by the upper guide member 110 and the rearward section 94 of the base member 90.

What is claimed is:

1. An image recording apparatus, comprising:

a tray configured to support a sheet;

a chassis defining a first conveyer path, in which the sheet supported on the tray is conveyed in a first conveying direction, and a second conveyer path, in which the sheet is conveyed in a second conveying direction to be inverted and guided to reenter the first conveyer path;

a base member integrally formed of resin and comprising a guiding section, the guiding section defining a form of a part of the second conveyer path;

a recording unit configured to record an image on the sheet conveyed in the first conveyer path; and a conveyer roller disposed on an upstream of the recording unit with regard to the first conveying direction and configured to convey the sheet in the first conveyer path in the first conveying direction, wherein the second conveyer path is configured to guide the sheet from a position on the upstream of the recording unit with regard to the first conveying direction to the first conveyer path through a curved path, and wherein the guiding section comprises:

a first guiding plane defining a form of a part of the second conveyer path on an upstream of the curved path with regard to the second conveying direction on a same side as a first guide member which defines a form of an outer side of the curved path; and a second guiding plane arranged to adjoin the first guiding plane side by side along a widthwise direction which intersects with the second conveying direction, the second guiding plane being formed to dent to be lower than the first guiding plane to be farther from a second guide member which faces with the first guiding plane and the second guiding plane across the second conveyer path.

2. The image recording apparatus according to claim 1, further comprising:

a drive shaft supported by the base member; and a return-conveyer roller configured to convey the sheet to be guided on the guiding section in the second conveying direction by rotation of the drive shaft, wherein the second guiding plane is arranged on a downstream of the return-conveyer roller with regard to the second conveying direction.

3. The image recording apparatus according to claim 2, further comprising:

a feeder roller configured to feed the sheet supported on the tray to the first conveyer path; and a feeder arm supported pivotaly by the drive shaft on one end thereof on an upstream with regard to a direction to feed the sheet, the feeder arm supporting the feeder roller rotatably on the other end thereof on a downstream with regard to the direction to feed the sheet, wherein the second guiding plane is arranged on a downstream of a supporting position, in which the base member supports the feeder arm, with regard to the second conveying direction.

4. The image recording apparatus according to claim 3, wherein the feeder arm is pivotably supported by the drive shaft;

wherein the feeder roller is rotatable by the rotation of the drive shaft; and wherein the image recording apparatus further comprises a return-conveyer arm pivotably supported by the drive shaft on one end thereof on an upstream with regard to the second conveying direction, the return-conveyer arm supporting the return-conveyer roller rotatably on the other end thereof on a downstream with regard to the second conveying direction.

5. The image recording apparatus according to claim 3, further comprising:

a flapper supported by the base member and configured to be movable at a merging point between the first conveyer path and the second conveyer path, the flapper being pivotable between a first position, in which the flapper guides the sheet conveyed by the return-conveyer roller to the first conveyer path, and a second position, in which the flapper guides the sheet fed by the feeder roller to the first conveyer path, wherein the flapper comprises a third guiding plane configured to guide the sheet conveyed by the return-conveyer roller toward the first conveyer path when the flapper is in the first position, the third guiding plane being arranged to continuously align with the second guiding plane when the flapper is in the first position.

6. The image recording apparatus according to claim 5, wherein the curved path forms the first conveyer path at a part including the merging point on an upstream of the conveyer roller with regard to the first conveying direction; and wherein the flapper is configured to contact the first guide member when the flapper is in the first position.

7. The image recording apparatus according to claim 1, wherein a dented amount of the second guiding plane with respect to the first guiding plane is greater toward a downstream along the second conveying direction and smaller toward an upstream along the second conveying direction.

8. The image recording apparatus according to claim 1, wherein the tray is configured to support the sheet being one of different-sized sheets;

wherein the image recording apparatus comprises an edge guide arranged to be slidable in the widthwise direction on the tray and configured to align a widthwise center of the sheet at a predetermined position by placing widthwise ends of the sheet supported on the tray at a correct position; and wherein the second guiding plane is arranged at a widthwise central area in a conveyable range for the different-sized sheets.

9. The image recording apparatus according to claim 1, further comprises:

a pair of lateral frames made of metal, the pair of lateral frames each being supported by the base member on each side of the first conveyer path with regard to a widthwise direction which intersects with the first conveying direction, wherein the conveyer roller is supported by the pair of lateral frames.

10. The image recording apparatus according to claim 9, further comprising:

a guide rail made of metal, the guide rail being supported by the pair of lateral frames and arranged to extend in the widthwise direction, wherein the recording unit comprises a carriage, the carriage being supported by the guide rail and configured to move in the widthwise direction, and a recording head mounted on the carriage and configured to discharge ink at the sheet.

* * * * *